US009291940B1

(12) United States Patent
Abler et al.

(10) Patent No.: US 9,291,940 B1
(45) Date of Patent: Mar. 22, 2016

(54) TONER FEED PROFILE

(71) Applicant: Lexmark International, Inc., Lexington, KY (US)

(72) Inventors: Jeffrey Abler, Georgetown, KY (US); Charles Alan Bast, Winchester, KY (US); Michael Craig Leemhuis, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/683,283

(22) Filed: Apr. 10, 2015

(51) Int. Cl.
*G03G 15/08* (2006.01)

(52) U.S. Cl.
CPC ..... *G03G 15/0863* (2013.01); *G03G 15/0865* (2013.01)

(58) Field of Classification Search
CPC ..... G03G 15/0834–15/0889
See application file for complete search history.

(56) References Cited

U.S. PATENT DOCUMENTS

2014/0105618 A1 4/2014 Gilmore
2014/0133873 A1* 5/2014 Nishikawa ..... G03G 15/0856 399/27
2014/0212155 A1 7/2014 Leemhuis

OTHER PUBLICATIONS

U.S. Appl. No. 14/306,416, Leemhuis, filed Jun. 17, 2014.

* cited by examiner

*Primary Examiner* — Clayton E Laballe
*Assistant Examiner* — Ruifeng Pu

(57) ABSTRACT

A replaceable unit for an electrophotographic image forming device according to one embodiment includes a body having a toner reservoir containing toner and a non-volatile memory device containing a table having a plurality of toner feed rates, each toner feed rate corresponds to the number of 1/1652 of a rotation a drive element turns to move one gram of toner out the outlet port at a predetermined amount of toner in the reservoir.

8 Claims, 7 Drawing Sheets

TONER FEED PROFILE

BACKGROUND

1. Field of the Invention

The present invention relates generally to electrophotographic image forming devices and more particularly to correcting non-ideal feeding behavior of a toner cartridge.

2. Description of the Related Art

In electrophotographic image forming devices, one or more replaceable toner cartridges may be used to supply toner to the device for printing onto sheets of media. When a toner cartridge is installed in an image forming device, the toner cartridge supplies toner stored in a reservoir within the toner cartridge through an outlet port on the toner cartridge to a corresponding inlet port in the device. Toner cartridges often include toner agitators, paddles or augers within the reservoir that fluff and mix the toner to prevent it from clumping and that move the toner to the outlet port.

Toner feed mechanisms have non-ideal feeding behavior such as feed rate that varies with the amount of toner remaining in a toner cartridge. This non-ideal feeding behavior may cause overshooting or undershooting of toner concentration in, for example, a dual component system that uses magnetic carrier beads mixed with toner. Out of bounds toner concentration may cause print defects, dusting of toner within the image forming device, etc. Systems that use a toner concentration sensor often have a delay between when toner is added to the mixture and when the toner concentration sensor settles to a new value. This delay makes it difficult to design a toner concentration control algorithm with small overshot and undershoot when the toner feed rate is not predictable. Further, if a toner concentration sensor is not used (for all or part of the time), variations in toner feed will degrade the control performance and may lead to out of bounds toner concentration.

SUMMARY

A toner cartridge for an image forming device according to one example embodiment is disclosed. The toner cartridge has a body having a toner reservoir, toner located in the toner reservoir, an outlet port, a toner feed mechanism, a drive element coupled to the toner feed mechanism such that rotation of the drive element causes the toner feed mechanism to move toner from the toner reservoir out the outlet port, and a non-volatile memory device containing a table having a plurality of toner feed rates, each toner feed rate corresponds to the number of 1/1652 of a rotation the drive element turns to move one gram of toner out the outlet port at a predetermined amount of toner in the reservoir.

A toner cartridge for an image forming device according to another example embodiment is disclosed. The toner cartridge has a body having a toner reservoir, toner located in the toner reservoir, an outlet port, a toner feed mechanism, a drive element coupled to the toner feed mechanism such that rotation of the drive element causes the toner feed mechanism to move toner from the toner reservoir out the outlet port, and a non-volatile memory device containing a table having a plurality of toner feed rates, each toner feed rate corresponds to the number of 1/Q of a rotation the drive element turns to move one gram of toner out the outlet port at a predetermined amount of toner in the reservoir, where Q is a scale factor stored in the non-volatile memory device.

A toner cartridge for an image forming device according to yet another example embodiment is disclosed. The toner cartridge has a body having a toner reservoir, toner located in the toner reservoir, an outlet port, a toner feed mechanism, a drive element coupled to the toner feed mechanism such that rotation of the drive element causes the toner feed mechanism to move toner from the toner reservoir out the outlet port, and a non-volatile memory device containing a table having a plurality of toner feed rates, each toner feed rate corresponds to the number of milligrams of toner that will move out the outlet port for one rotation of the drive element at a predetermined amount of toner in the reservoir.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
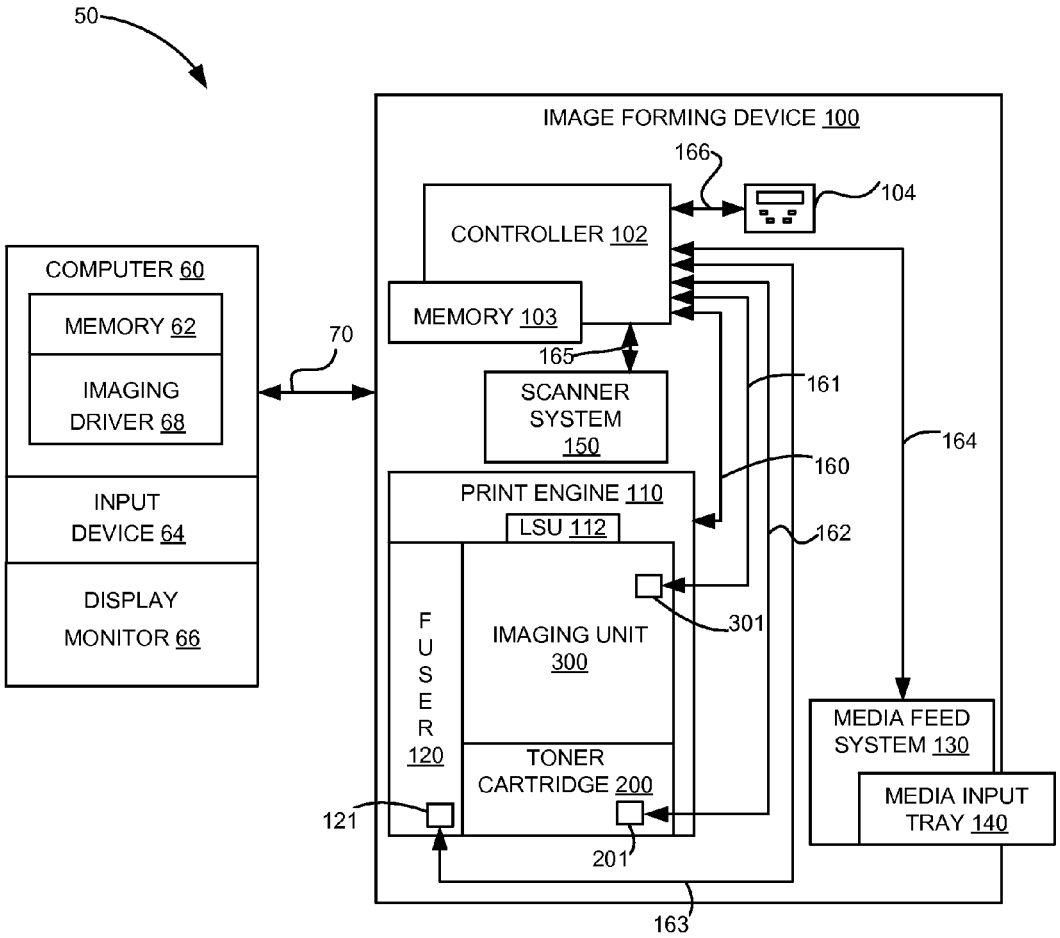
FIG. 1 is a block diagram of an imaging system including an image forming device according to one example embodiment.

Referring to the drawings and particularly to FIG. 1, there is shown a block diagram depiction of an imaging system 50 according to one example embodiment. Imaging system 50 includes an image forming device 100 and a computer 60. Image forming device 100 communicates with computer 60 via a communications link 70. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction device (sometimes referred to as an all-in-one (AIO) device) that includes a controller 102, a user interface 104, a print engine 110, a laser scan unit (LSU) 112, one or more toner bottles or cartridges 200, one or more imaging units 300, a fuser 120, a media feed system 130 and media input tray 140, and a scanner system 150. Image forming device 100 may communicate with computer 60 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging unit(s) 300, respectively. Controller 102 processes print and scan data and operates print engine 110 during printing and scanner system 150 during scanning.

Computer 60, which is optional, may be, for example, a personal computer, including memory 62, such as RAM, ROM, and/or NVRAM, an input device 64, such as a keyboard and/or a mouse, and a display monitor 66. Computer 60 also includes a processor, input/output (I/O) interfaces, and may include at least one mass data storage device, such as a hard drive, a CD-ROM and/or a DVD unit (not shown). Computer 60 may also be a device capable of communicating with image forming device 100 other than a personal computer such as, for example, a tablet computer, a smartphone, or other electronic device.

In the example embodiment illustrated, computer 60 includes in its memory a software program including program instructions that function as an imaging driver 68, e.g., printer/scanner driver software, for image forming device 100. Imaging driver 68 is in communication with controller 102 of image forming device 100 via communications link 70. Imaging driver 68 facilitates communication between image forming device 100 and computer 60. One aspect of imaging driver 68 may be, for example, to provide formatted print data to image forming device 100, and more particularly to print engine 110, to print an image. Another aspect of imaging driver 68 may be, for example, to facilitate the collection of scanned data from scanner system 150.

In some circumstances, it may be desirable to operate image forming device 100 in a standalone mode. In the standalone mode, image forming device 100 is capable of functioning without computer 60. Accordingly, all or a portion of imaging driver 68, or a similar driver, may be located in controller 102 of image forming device 100 so as to accommodate printing and/or scanning functionality when operating in the standalone mode.

Figure 2:
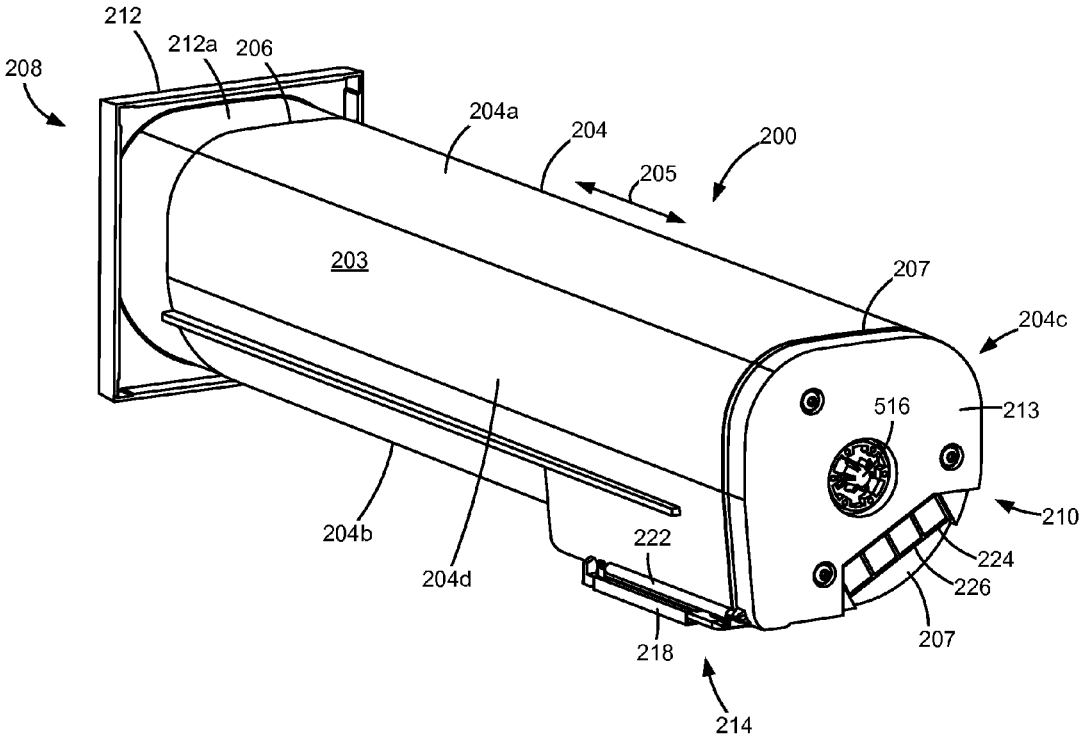
FIG. 2 is a perspective view of a toner cartridge of the image forming device according to one example embodiment.

FIG. 2 shows toner cartridge 200 according to one example embodiment. Toner cartridge 200 includes an elongated housing 203 that includes walls forming a toner reservoir 202 (see FIG. 3). In the example embodiment illustrated, housing 203 includes a generally cylindrical wall 204 that extends along a lengthwise dimension 205 and a pair of end walls 206, 207 defining a front end 208 and a rear end 210, respectively, of toner cartridge 200. Wall 204 includes a top 204*a*, bottom 204*b* and sides 204*c*, 204*d*. In the embodiment illustrated, end caps 212, 213 are mounted on end walls 206, 207, respectively, such as by suitable fasteners (e.g., screws, rivets, etc.) or by a snap-fit engagement. An outlet port 214 is positioned on bottom 204*b* of housing 203 near end wall 207. Toner is periodically delivered from reservoir 202 through outlet port 214 to an inlet port of imaging unit 300 to refill a reservoir of imaging unit 300 as toner is consumed by the printing process.

As desired, outlet port 214 may include a shutter or cover that is movable between a closed position blocking outlet port 214 to prevent toner from flowing out of toner cartridge 200 and an open position permitting toner flow. For example, in the embodiment illustrated, a shutter 218 is positioned on bottom 204*b* of housing 203 and is slidably movable between a closed position and an open position. In the open position, shutter 218 permits toner to flow from outlet port 214 of toner cartridge 200. In the closed position, shutter 218 blocks outlet port 214 to prevent toner from escaping toner cartridge 200. In one embodiment, shutter 218 includes a foam seal attached to an inner surface thereof that seals against outlet port 214 when shutter 218 is in the closed position to collect any toner that escapes outlet port 214 when toner cartridge is removed from image forming device 100. Shutter 218 may be biased toward the closed position blocking outlet port 214. For example, one or more extension springs 222 may bias shutter 218 toward the closed position as shown. In the example embodiment illustrated, shutter 218 slides toward front end 208 when shutter 218 moves from the closed position to the open position and toward rear end 210 when shutter 218 moves from the open position to the closed position.

Toner cartridge 200 includes one or more electrical contacts 224 positioned on the outer surface of housing 203, e.g., on end wall 207. In one embodiment, electrical contacts 224 are positioned on a printed circuit board 226 that also includes processing circuitry 201. Processing circuitry 201 may provide authentication functions, safety and operational interlocks, operating parameters and usage information related to toner cartridge 200. Electrical contacts 224 are positioned to contact corresponding electrical contacts when toner cartridge 200 is installed in image forming device 100 in order to facilitate communications link 162 with controller 102. Processing circuitry 201 contains non-volatile memory.

Figure 3:
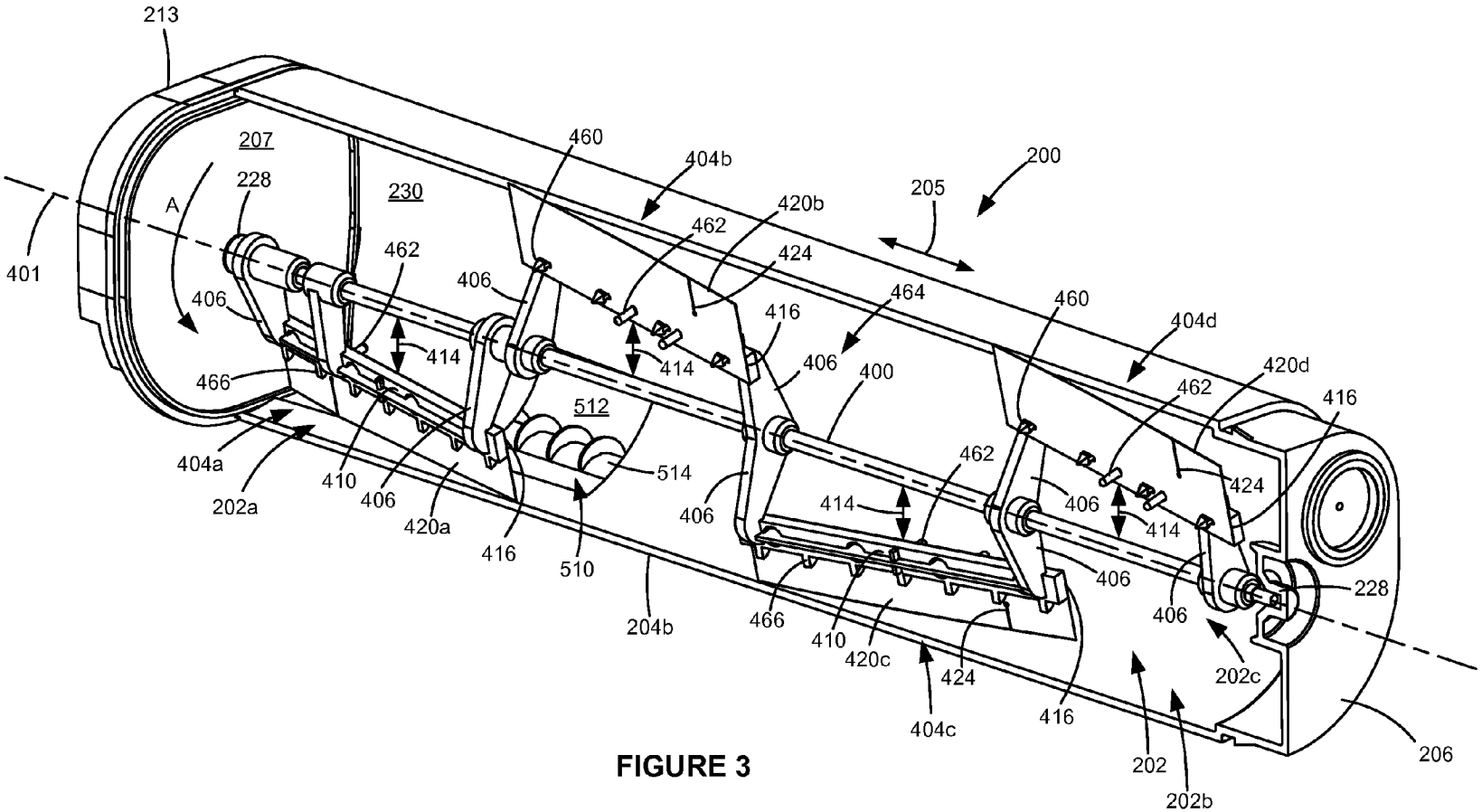
FIG. 3 is a perspective view of the toner cartridge of FIG. 3 with a portion of an outer wall removed according to one example embodiment.

FIG. 3 shows toner cartridge 200 with end cap 212 and a portion of wall 204 removed to more clearly illustrate the internal components of toner cartridge 200. A rotatable shaft 400 extends along the length of toner cartridge 200 within toner reservoir 202. As desired, the ends of rotatable shaft 400 may be received in bushings or bearings 228 positioned on an inner surface of end walls 206, 207. In operation, shaft 400 rotates in the direction shown by arrow A in FIGS. 4 and 5. Toner paddles 404 are mounted on and rotate with shaft 400 to stir and move toner within reservoir 202 as discussed in greater detail below. In one embodiment, shaft 400 is composed of metal, such as steel, to handle high torque loads resulting from the resistance to the rotation of paddles 404 provided by toner in reservoir 202. This resistance is particularly high when toner cartridge 200 is unused for an extended period of time, such as during shipping or storage, which may cause the toner in reservoir 202 to pack. In other embodiments, shaft 400 is composed of a rigid plastic material. In the example embodiment illustrated, toner cartridge 200 includes four paddles labeled 404*a*, 404*b*, 404*c* and 404*d*; however, more or fewer than four paddles 404 may be used as desired depending on, for example, the size of reservoir 202.

In one embodiment, each paddle 404 includes a pair of arms 406 that extend away from shaft 400 toward an interior surface 230 of housing 203 that forms reservoir 202. A crossbeam 410 is positioned between distal ends of each pair of arms 406 near interior surface 230. In the example embodiment illustrated, each crossbeam 410 includes a straight segment. A wiper 420 is mounted on an outer radial end of each crossbeam 410 across a flat surface 416 of the crossbeam 410. Wipers 420 are formed from a flexible material such as a polyethylene terephthalate (PET) material, e.g., MYLAR® available from DuPont Teijin Films, Chester, Va., USA. In one embodiment, wipers 420 form an interference fit with the interior surfaces 230 of top 204*a*, bottom 204*b* and sides 204*c*, 204*d* in order to wipe toner from the interior surfaces 230 as shaft 400 rotates. In the example embodiment illustrated, toner cartridge 200 includes four wipers labeled 420*a*, 420*b*, 420*c* and 420*d* corresponding with the four paddles 404*a*, 404*b*, 404*c*, and 404*d*.

In one embodiment, a gap 414 is formed between each crossbeam 410 and shaft 400 to allow toner in reservoir 202 to freely move near a central core 202*c* of reservoir 202 along a longitudinal axis 401 of shaft 400. This keeps toner fluffed, minimizes the torque on shaft 400, and reduces the surface area where toner can stick.

In some embodiments, paddles 404 are composed of a rigid plastic material. Paddles 404 may be formed individually or as a unitary assembly. For example, in the embodiment illustrated, paddles 404 are formed as a unitary plastic assembly over molded on shaft 400.

Figure 4:
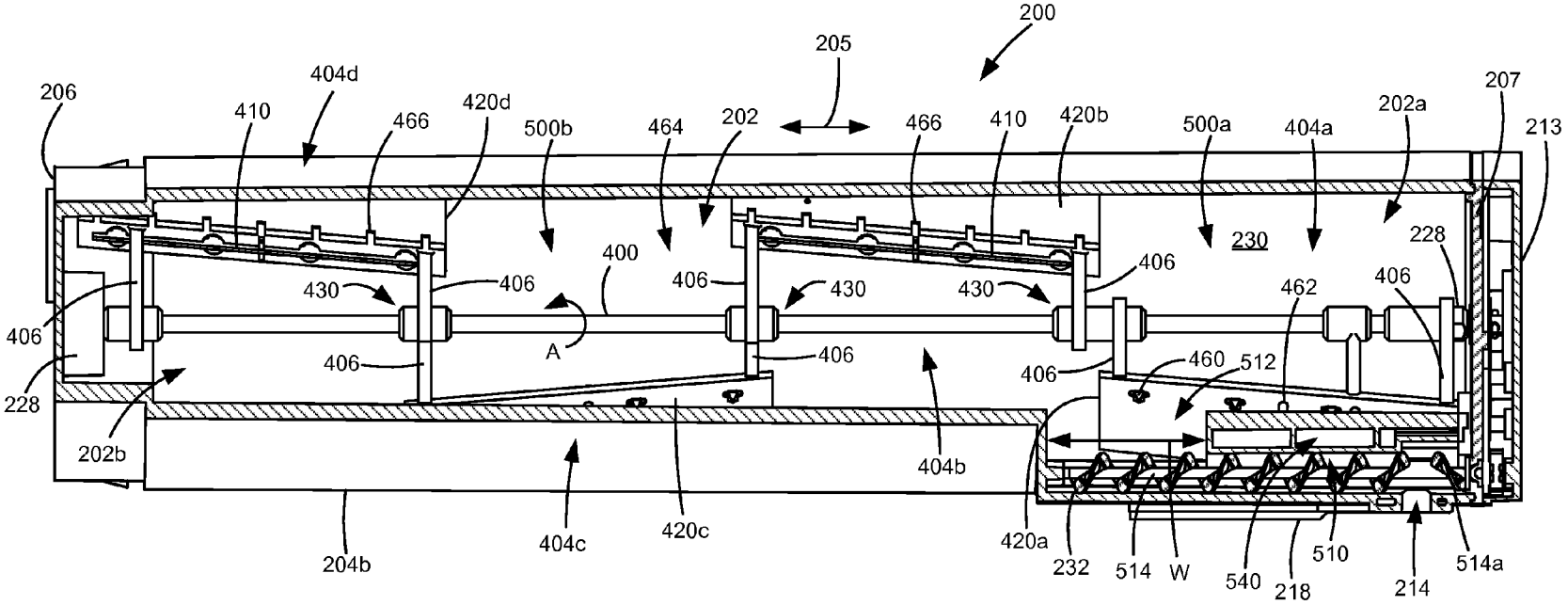
FIG. 4 is a side cross-sectional view of the toner cartridge of FIGS. 2 and 3 showing a toner metering zone according to one example embodiment.

FIG. 4 shows a side cross section of toner cartridge 200. In the example embodiment illustrated, housing 203 includes a channel 510 along at least a portion of bottom 204*b* of toner cartridge 200. Channel 510 includes an inlet 512 that is open at one end of channel 510 to reservoir 202 to receive toner from reservoir 202. Inlet 512 has a width W along lengthwise dimension 205 and is positioned between end walls 206 and 207. Channel 510 is open at its other end to outlet port 214 for exiting toner from channel 510. In the example embodiment illustrated, inlet 512 is positioned below an intersection or junction 430 of paddles 404*a* and 404*b* to allow both paddle 404*a* and paddle 404*b* to direct toner to inlet 512 of channel 510 as discussed in greater detail below. As desired, the width W and the position of inlet 512 along bottom 204*b* of housing 203 may be varied.

A toner feed mechanism includes a rotatable auger 514 positioned along channel 510 for moving toner received at inlet 512 to outlet port 214. Channel 510 includes a closed metering zone 540 positioned between inlet 512 and outlet port 214. Metering zone 540 regulates the amount of toner delivered by auger 514 to outlet port 214 in order to provide a more consistent flow rate of toner from toner cartridge 200 to imaging unit 300. In the example embodiment illustrated, four flutes of auger 514 are open to inlet 512 to receive toner from reservoir 202 in order to ensure that auger 514 is filled with toner in metering zone 540 as discussed in greater detail below.

With reference back to FIG. 2, a drive element 516 in the form of a gear or other form of drive coupler is exposed on an outer portion of housing 203 in position to receive rotational force from a corresponding drive element in image forming device 100 when toner cartridge 200 is installed in image forming device 100. In the example embodiment illustrated, drive element 516 is positioned on an outer surface of end wall 207; however, drive element 516 may be positioned elsewhere on housing 203 as desired. In one embodiment, drive element 516 is operatively connected (either directly or indirectly through one or more intermediate gears) to shaft 400 and auger 514 to rotate shaft 400 and auger 514 upon receiving rotational force from the corresponding drive element in image forming device 100. In another embodiment, drive element 516 is operatively connected to shaft 400 and a second drive element (not shown) is exposed on the outer portion of housing 203 to receive rotational force from a second drive element in image forming device 100 to rotate auger 514.

With reference to FIGS. 3 and 4, in one embodiment, adjacent paddles 404 alternate radially by 180 degrees along the length of shaft 400. This arrangement of paddles 404 keeps the torque on shaft 400 more uniform in comparison with paddles 404 all extending in the same radial direction. As the toner level in reservoir 202 decreases, where toner cartridge 200 includes an even number of paddles 404, half of the paddles 404 are out of the toner in reservoir 202 and half of the paddles 404 are in the toner at various points along the rotational path of shaft 400 thereby evening out the torque on shaft 400 through the rotational path of shaft 400. Further, if toner cartridge 200 is unused for an extended period of time, such as during shipping or storage, if half of the paddles 404 are out of the toner when rotation of shaft 400 resumes, the torque on shaft 400 is reduced in comparison with all of the paddles 404 being positioned in the toner thereby reducing the risk of breaking shaft 400 or paddles 404 due to excessive torque resulting from packed toner. Further, where paddles 404 are formed as a unitary molded plastic assembly, alternating adjacent paddles 404 radially by 180 degrees makes it easier to mold the paddle assembly.

In one embodiment, a paddle assembly 464 includes a first set 500*a* of one or more paddles 404 that are positioned between a first end 202*a* of reservoir 202 and inlet 512 and a second set 500*b* of one or more paddles 404 that are positioned between a second end 202*b* of reservoir 202 and inlet 512. First set 500*a* of paddles 404 are angled to direct toner away from first end 202*a* of reservoir 202 and toward inlet 512. Second set 500*b* of paddles 404 are angled to direct toner away from second end 202*b* of reservoir 202 and toward inlet 512. In the example embodiment illustrated, first set 500*a* of paddles 404 includes paddle 404*a* and second set 500*b* of paddles 404 includes paddles 404*b*, 404*c* and 404*d*; however, any number of paddles 404 may be included in each set 500*a*, 500*b* as desired. In another embodiment, all of the paddles 404 of toner cartridge 200 are angled to direct toner away from either first end 202*a* or second end 202*b* of reservoir 202 toward the opposite end 202*a* or 202*b* to inlet 512 or directly to outlet port 214 where toner cartridge 200 does not include a channel 510.

The gear ratio between shaft 400 and auger 514 may be selected to achieve a desired toner feed rate from reservoir 202. In general, the number of rotations of auger 514 per rotation of shaft 400 is less than the number of flutes of auger 514 that are open to inlet 512 multiplied by the number of times toner is delivered to inlet 512 per rotation of shaft 400. As discussed above, in the example embodiment illustrated, four flutes of auger 514 are open to inlet 512 to receive toner from reservoir 202, and toner is delivered to inlet 512 twice per revolution of shaft 400 (once by paddle 404*a* and once by paddle 404*b*). Accordingly, in this embodiment, the gear ratio between shaft 400 and auger 514 is less than 8:1 (i.e., for every rotation of shaft 400, auger 514 rotates less than eight times). For example, in one embodiment, the gear ratio between shaft 400 and auger 514 is between about 3:1 and about 4:1, such as about 3.3:1, in order to ensure that auger 514 is filled with toner as it enters metering zone 540.

Figure 5:
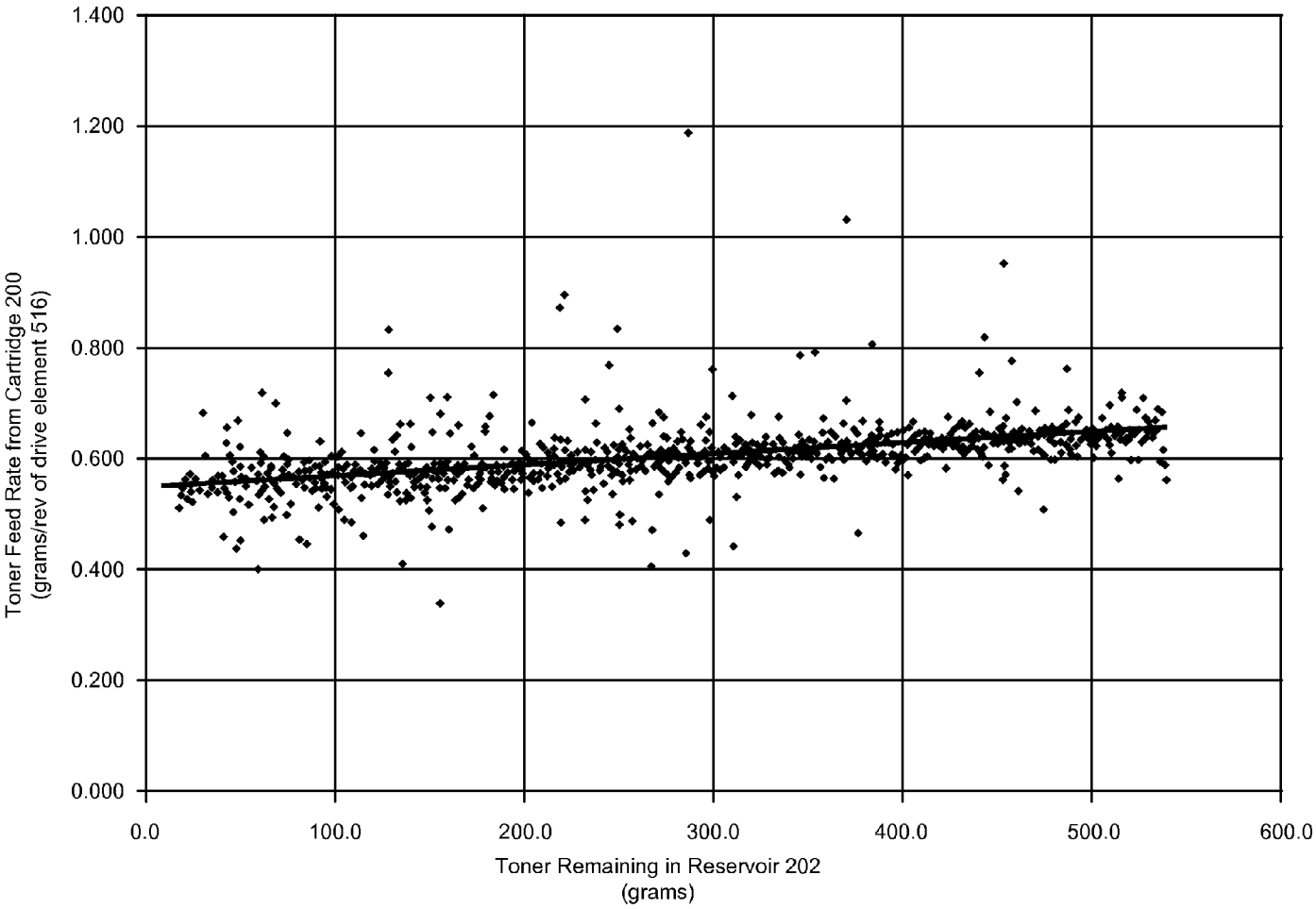
FIG. 5 is a plot of a feed rate of toner exiting a reservoir versus an amount of toner remaining in the reservoir over the life of one example embodiment of a toner cartridge.

It has been observed that the feed rate of toner from reservoir 202 decreases in a nearly linear fashion as the toner level in reservoir 202 decreases with normal variations due to such factors as the properties of toner, environmental conditions, and hardware tolerances. For example, FIG. 5 shows a plot of the feed rate of toner exiting reservoir 202 (in grams per revolution of drive element 516) versus the amount of toner remaining in reservoir 202 (in grams) over the life of one example embodiment of toner cartridge 200. The geometry and rotational speed of agitators and the rotatable auger (if present) determine how much toner is fed per revolution of drive element 516. It will be appreciated by those skilled in the art that the use of a rotatable auger to exit toner from reservoir 202 helps control the precision of the feed rate of toner exiting toner cartridge 200. The linear decrease in the feed rate of toner from reservoir 202 is due to the decrease in density of the toner in reservoir 202 as the height of toner decreases.

Figure 6:
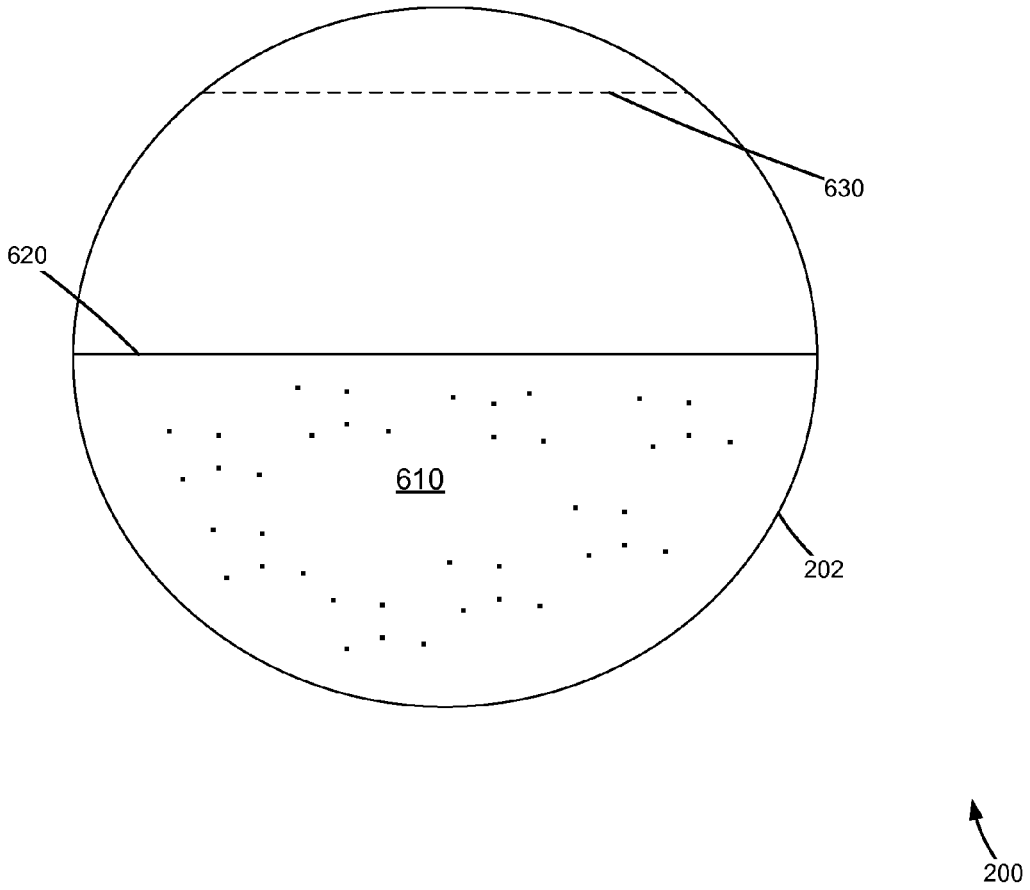
FIG. 6 is a schematic illustration of the toner cartridge of FIG. 2 with toner according to one example embodiment.

FIG. 6 is a schematic illustration of the toner cartridge 200 with toner 602 according to one example embodiment. In this example, the current toner height 620 is less than the initial fill level 630, which is less than the total capacity of the toner reservoir 202. The initial fill level is set by the amount of toner put into the toner cartridge 200 at manufacturing before it is shipped to a customer.

Figure 7:
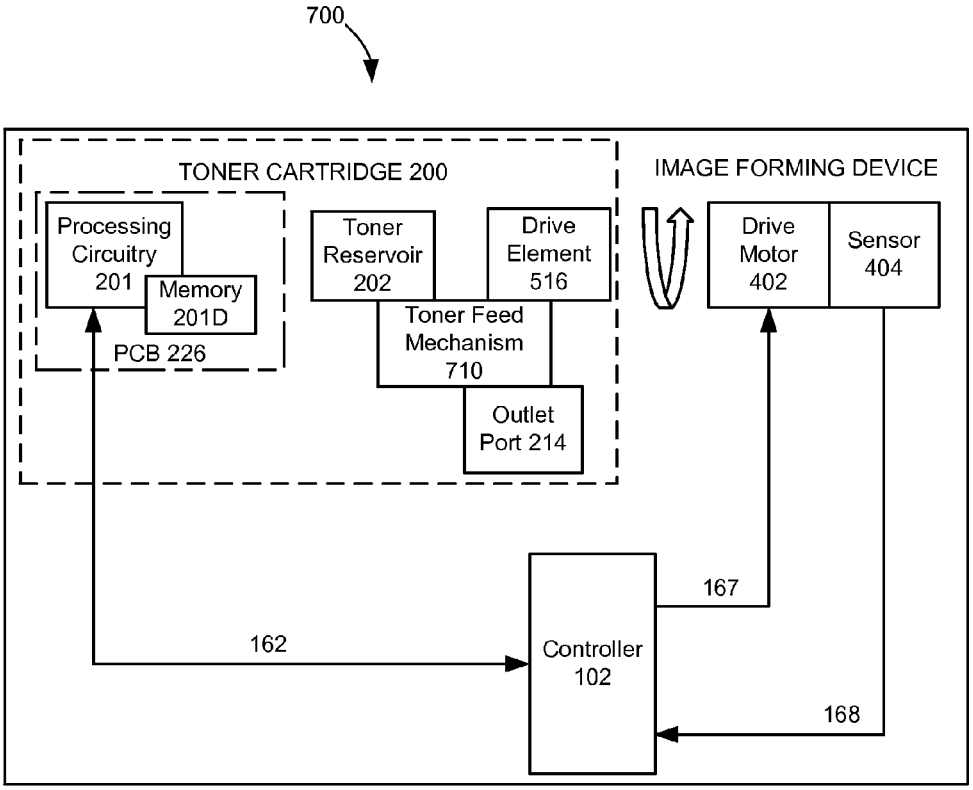
FIG. 7 is a block diagram depiction of a toner delivery system according to one example embodiment.

FIG. 7 is a block diagram depiction of a toner delivery system 700 according to one example embodiment. In this embodiment, drive motor 402 rotates drive element 516 to activate toner feed mechanism 710 to move toner from the toner reservoir 202 out the outlet port 214. Processing circuitry 201 includes non-volatile memory 201D containing a table having a plurality of toner feed rates. Processing circuitry 201 of toner cartridge 200 communicates with controller 102 via communications link 162. Controller 102 communicates with a drive motor 402 in image forming device 100, 100' via a communications link 167 to selectively power drive motor 402. Drive motor 402 provides rotational motion to drive element 516 when toner cartridge 200 is installed in the image forming device. Drive motor 402 includes an encoder device, such as a conventional encoder wheel mounted on the shaft of drive motor 402, and a corresponding sensor 404, such as a corresponding optical sensor, that detects the rotation of the shaft of drive motor 402. Sensor 404 communicates with controller 102 via a communications link 168 allowing controller 102 to monitor the rotation of drive motor 402.

Non-volatile memory 201D contains, for example, the table of toner feed rates shown below:

TABLE 1

| Percentage of Initial Fill | 1/Q of a Rotation of the Drive Element |
|---|---|
| 100% | 2559 |
| 90% | 2604 |

TABLE 1-continued

| Percentage of Initial Fill | 1/Q of a Rotation of the Drive Element |
|---|---|
| 80% | 2651 |
| 70% | 2700 |
| 60% | 2751 |
| 50% | 2804 |
| 40% | 2859 |
| 30% | 2916 |
| 20% | 2975 |
| 10% | 3037 |
| 0% | 3101 |

In this example, Q is equal to 1652 because the sensor 404 will produce 1652 encoder pulses for one complete rotation of the drive element 516 due to gears between the drive motor 402 and the drive element 516 (gear ratio of 284/11*64 window encoder wheel=1652 encoder pulses for one complete rotation of the drive element 516). Of course, other values of Q are contemplated to correspond to different gear ratios, different encoder wheels, etc. Q is a scale factor, and the value of Q may also be stored in non-volatile memory 201D. Preferably, the bytes of the table of toner feed rates are contiguous e.g. stored at consecutive memory addresses and the stored value of Q is contiguous with the table. Of course, toner feed rate may be expressed in other forms such as, for example, the number of milligrams of toner that will move out the outlet port for one rotation of the drive element 516.

The table of toner feed rates may be used by a toner concentration control algorithm to minimize overshoots and undershoots of toner concentration relative to magnetic carrier beads. The control algorithm may be designed to request a predetermined number of grams of toner to be moved out the outlet port 214 and the table may be used to convert grams, which the imaging device cannot directly measure, to encoder counts, which the imaging device can directly measure. The table will make the amount of delivered toner more predictable which will make the control algorithm more stable. This will contribute to improved print quality and reduce the likelihood of dusting.

It is preferable to store the table of toner feed rates in the toner bottle instead of in the imaging device. For example, when production changes are made to the toner feed mechanism the corresponding toner feed rate table may be updated. For example, improvements in the feed mechanism may reduce toner feed variability such that multiple feed rate table elements may hold the same value. In this way, toner cartridges with different toner feed mechanisms may be interchanged in the same imaging device without requiring updates to the imaging device firmware.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. A toner cartridge for an image forming device comprising:

a body having a toner reservoir;

toner located in the toner reservoir;

an outlet port;

a toner feed mechanism;

a drive element coupled to the toner feed mechanism such that rotation of the drive element causes the toner feed mechanism to move toner from the toner reservoir out the outlet port; and a non-volatile memory device containing a table having a plurality of toner feed rates, each toner feed rate corresponds to the number of 1/1652 of a rotation the drive element turns to move one gram of toner out the outlet port at a predetermined amount of toner in the reservoir.

2. The toner cartridge of claim 1, wherein the predetermined amount is a percentage of the total capacity of the toner reservoir.

3. The toner cartridge of claim 2, wherein the table contains a toner feed rate for each of 100%, 90%, 80%, 70%, 60%, 50%, 40%, 30%, 20%, and 10% of the total capacity of the toner reservoir.

4. The toner cartridge of claim 3, wherein the toner feed rate for 90% of the total capacity is less than the toner feed rate for 10% of the total capacity.

5. The toner cartridge of claim 1, wherein the predetermined amount is a percentage of an initial fill of toner.

6. The toner cartridge of claim 5, wherein the table contains a toner feed rate for each of 100%, 90%, 80%, 70%, 60%, 50%, 40%, 30%, 20%, and 10% of the initial fill of toner.

7. The toner cartridge of claim 6, wherein the toner feed rate for 90% of the initial fill of toner is less than the toner feed rate for 10% of the initial fill of toner.

8. The toner cartridge of claim 1, wherein the table is stored in contiguous bytes of the non-volatile memory.

* * * * *